US006285246B1

(12) United States Patent
Basu

(10) Patent No.: US 6,285,246 B1
(45) Date of Patent: Sep. 4, 2001

(54) LOW DROP-OUT REGULATOR CAPABLE OF FUNCTIONING IN LINEAR AND SATURATED REGIONS OF OUTPUT DRIVER

(75) Inventor: Sudip Basu, Milpitas, CA (US)

(73) Assignee: California Micro Devices, Inc., Milpitas, CA (US)

( * ) Notice: Subject to any disclaimer, the term of this patent is extended or adjusted under 35 U.S.C. 154(b) by 0 days.

(21) Appl. No.: 09/153,571

(22) Filed: Sep. 15, 1998

(51) Int. Cl.[7] ..... G05F 1/10; G05F 3/02
(52) U.S. Cl. ..... 327/541; 323/316
(58) Field of Search ..... 327/540, 541; 323/316

(56) References Cited

U.S. PATENT DOCUMENTS 5,867,015 * 2/1999 Corsi et al. ..... 323/316
5,929,696 * 7/1999 Lim et al. ..... 327/540
5,982,226 * 11/1999 Rincon-Mora ..... 327/541

OTHER PUBLICATIONS

Gabriel A. Rincon–Mora and Phillip E. Allen A Low–Voltage, Low Quiescent Current, Low Drop–Out Regulator, Jan. 1998, IEEE Journal of Solid State Circuits, vol. 33.

* cited by examiner

*Primary Examiner*—Terry D. Cunningham
*Assistant Examiner*—Quan Tra
(74) *Attorney, Agent, or Firm*—Beyer Weaver & Thomas LLP

(57) ABSTRACT

A low drop-out regulator and methods for producing a low drop-out voltage are provided. A driver transistor adapted for connecting to an input supply voltage and producing an output voltage is provided. In addition, a mirroring transistor is coupled to the driver transistor and a voltage differential between the drain and the source of the driver transistor is mirrored in the mirroring transistor. The low drop-out regulator operates in both linear and saturation regions of the driver transistor. The driver transistor and the mirroring transistor are implemented in a CMOS process.

12 Claims, 7 Drawing Sheets

LOW DROP-OUT REGULATOR CAPABLE OF FUNCTIONING IN LINEAR AND SATURATED REGIONS OF OUTPUT DRIVER

BACKGROUND OF THE INVENTION

1. Field of Invention

The present invention relates to voltage regulators. More particularly, the present invention relates to low drop-out regulators implemented in a CMOS process.

2. Description of the Related Art

A voltage regulator is a device that produces an approximately constant output voltage. This output voltage will remain constant even if the load current changes. Similarly, the voltage regulator ensures that the output voltage remains constant for a variable input supply voltage. Accordingly, the regulator ensures that the output voltage is constant when at least one of the input voltage and the load current varies.

Referring to FIG. 1, a general block diagram illustrating a low drop-out regulator is presented. Typically, a low drop-out regulator 100 is used to maintain a low drop-out voltage. The drop-out voltage is the difference in voltage between an input voltage provided by an input supply 102 and an output voltage drawn by a load 104. It is desirable to maintain a low drop-out voltage in many instances to maximize the efficiency of a circuit, therefore minimizing voltage and power loss. This is particularly important in applications where the supply voltage is low (e.g., 3–12 volts). By way of example, for an input supply voltage of 5 volts and a drop-out voltage of 3 volts, the maximum output voltage that may be produced is 2 volts. This results in greater than 50% voltage and power loss. Accordingly, such voltage and power loss is typically minimized in low drop-out mode through the use of low drop-out regulators.

Low drop-out regulators are commonly fabricated using bipolar transistors. One beneficial characteristic of bipolar transistors is an approximately constant base-emitter voltage $V_{BE}$. Thus, $V_{BE}$ remains constant regardless of the current through the transistor. Bipolar transistors are therefore ideal for use in applications such as the low drop-out regulator.

While low drop-out regulators may be fabricated using bipolar transistors, there are numerous advantages that may be provided by CMOS transistors. Currently, CMOS transistors are commonly used in the semiconductor industry in the fabrication of integrated circuits. Thus, it would be advantageous if a low drop-out regulator could be fabricated and integrated in such integrated circuits using a single process. Moreover, implementing an existing process would allow regulator designers to take advantage of existing research, reducing the design and fabrication costs. It would therefore be desirable if a low drop-out regulator could be fabricated using CMOS transistors rather than bipolar transistors.

Although the development of low drop-out regulators in the CMOS process would be beneficial, it is difficult to achieve a functionality equivalent to low drop-out regulators developed in the bipolar process. As described above, the $V_{BE}$ of a bipolar transistor remains constant. The equivalent of the $V_{BE}$ in a bipolar transistor is the ground-source voltage $V_{GS}$ in a CMOS transistor. However, since the $V_{GS}$ is not constant, the functionality of a low drop-out regulator cannot easily be duplicated using a CMOS process.

Various methods for fabricating low drop-out regulators in the CMOS process have been attempted. However, these regulators have been capable of functioning only when the driver transistor is in saturation region which means higher power loss. Accordingly, it would be desirable if a low drop-out regulator could be developed in the CMOS process that would be operable in both the linear and the saturation regions as well as provide reduced power consumption and operating costs.

SUMMARY OF THE INVENTION

The present invention provides a low drop-out regulator and methods for providing a low drop-out regulator implemented in a CMOS process that is capable of functioning in both linear and saturation regions of the driver transistor. This is accomplished through providing accurate mirroring of the load current in both the linear and the saturation regions. In this manner, the voltage differential between the source and drain of a driver transistor is mirrored in a mirroring transistor.

According to one aspect of the present invention, the voltage differential between the drain and the source of the driver transistor is mirrored in the mirroring transistor. A driver transistor and a mirroring transistor are provided. The driver transistor is adapted for connecting to an input supply voltage and producing an output voltage. The mirroring transistor is coupled to the driver transistor and a voltage differential between the drain and the source of the driver transistor is mirrored in the mirroring transistor. This may be accomplished through coupling the source of the driver and mirroring transistors to the input supply voltage. In addition, a mirroring circuit may be provided to sense the output voltage at the drain of the driver transistor and force the voltage at the drain of the mirroring transistor to the sensed voltage. Each transistor may be implemented in a P-channel MOS transistor as well as an N-channel MOS transistor.

The advantages of implementing a low drop-out regulator in a CMOS process are numerous. By way of example, the low drop-out regulator may be fabricated and integrated in integrated circuits using a single process. Since an existing process may be used, the benefits of existing research may be obtained. Moreover, the present invention operates with a power consumption lower than provided by other CMOS low drop-out regulator designs. Accordingly, the present invention provides reduced power consumption and operating costs, as well as reduced manufacturing costs.

DETAILED DESCRIPTION OF THE EMBODIMENTS

In the following description, numerous specific details are set forth in order to provide a thorough understanding of the present invention. It will be obvious, however, to one skilled in the art, that the present invention may be practiced without some or all of these specific details. In other instances, well known process steps have not been described in detail in order not to unnecessarily obscure the present invention.

An invention is described herein that provides a low drop-out regulator fabricated using a CMOS process. This is accomplished in part through accurate mirroring of the load current in both linear and saturation regions. Accordingly, the CMOS low drop-out regulator provides a low drop-out voltage in all regions of operation.

Figure 2:
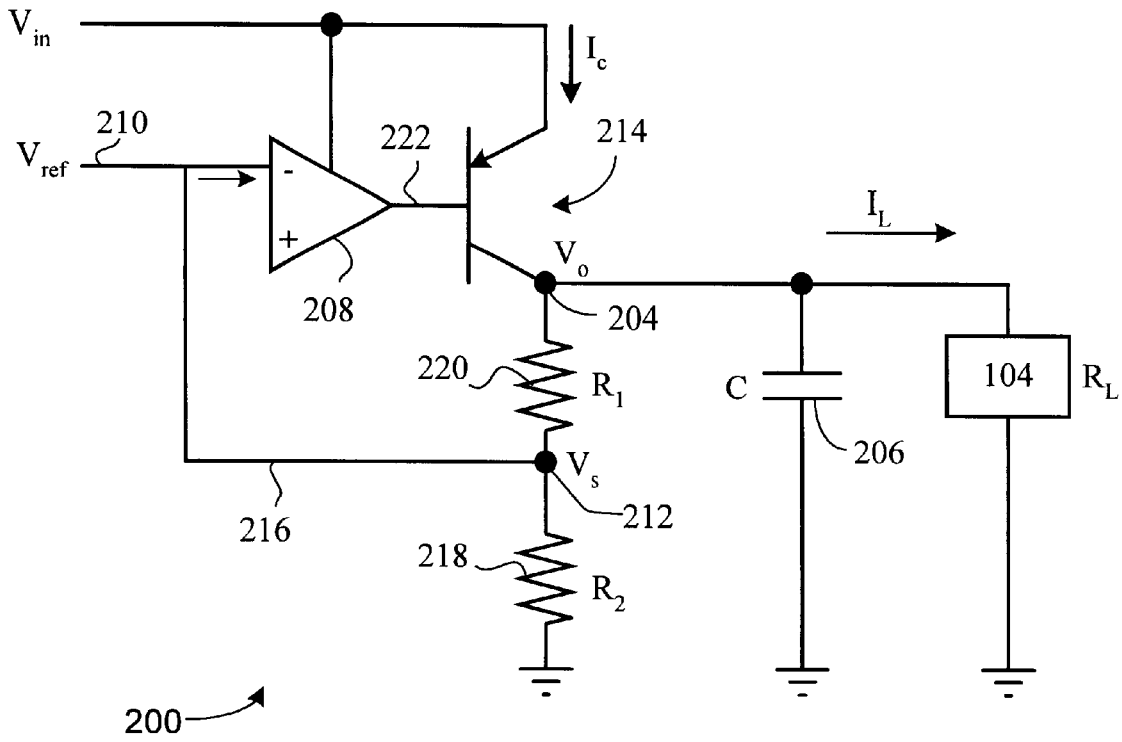
FIG. 2 is a circuit diagram illustrating a low drop-out regulator fabricated using a bipolar process.

As described above, a common method for fabricating low drop-out regulators is through the use of a bipolar process. Referring to FIG. 2, a circuit diagram illustrating a low drop-out regulator 200 fabricated using a bipolar process is presented. The low drop-out regulator 200 accepts a variable input voltage Vin 202 and produces a constant output voltage Vo 204. As shown, a load capacitance 206 associated with the load 104 is provided. The regulator 200 includes an op amp 208 having a negative input coupled to an internal reference voltage Vref 210 and a positive input coupled to a voltage Vs 212. By way of example, the op amp 208 may be a CMOS or bipolar op amp. The internal reference voltage 210 is a constant voltage that is typically generated by conventional circuitry. The regulator further includes a driver transistor 214 coupled to the output voltage 204. Since the input of the op amp 208 is typically a CMOS transistor, the current through path 216 is approximately zero. Therefore, the voltage Vs 212=Vo 204$*R_2$ 218/($R_1$ 220+$R_2$ 218) according to a conventional voltage divider.

Figure 1:
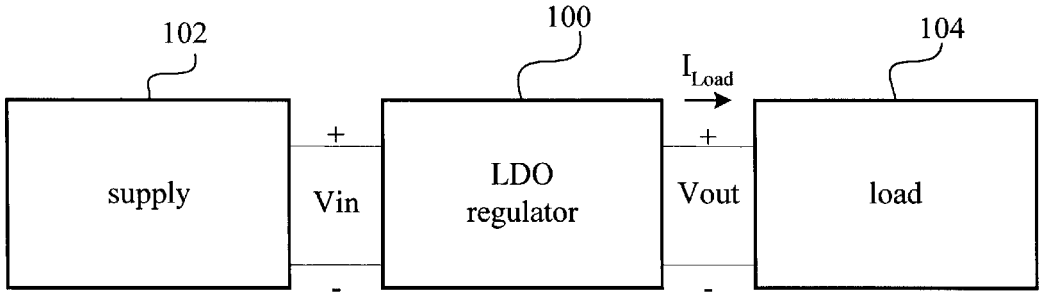
Fig. 1 Prior Art
FIG. 1 is a prior art diagram illustrating a low drop-out regulator.

Once the voltage Vs 212 has been obtained, the output voltage 204 produced by the regulator 200 may be determined. Since the op amp 208 is a high gain amplifier that provides a gain of between approximately $10^4$ and approximately $10^5$, the voltage difference between the reference voltage 210 provided at the negative input of the op amp 208 and the voltage provided at the positive input of the op amp 208 is negligible. As a result, Vs 212 is approximately equal to Vref 210. Thus, Vref 210≈Vo204$*R_2$ 218/($R_1$ 220+$R_2$ 218). If Vref 210 and the ratio of resistances 218, 220 do not vary, then the output voltage Vo 204 will remain constant, approximately equivalent to Vref 210$*(R_1$ 220+$R_2$ 218)/$R_2$ 218. Accordingly, the regulator 200 ensures that the output voltage 204 remains constant even when the input voltage 202 and/or the current through the load 104 (shown in FIG. 1) varies.

The characteristics of bipolar transistors are ideal for applications such as the low drop-out regulator. As described above, as the current through the load 104 increases, the base-emitter voltage Vbe of the driver transistor 214 will be approximately constant. As shown, the Vbe is equivalent to the voltage differential between the input voltage 202 and voltage 222. In addition, the collector-emitter voltage $V_{CE}$ of the driver transistor remains low (e.g., 0.1 V) in saturation mode. Since $V_{CE}$ as shown in FIG. 2 is the voltage differential between the input voltage 202 and the output voltage 204, the drop-out voltage can be as low as approximately 0.1 volt in saturation mode. Moreover, if another bipolar transistor were used to mirror the current through the driver transistor 214, both transistors would remain in the active region throughout the operation at this low $V_{CE}$. Although low drop-out regulators may be fabricated using a bipolar process, there are numerous advantages to fabricating low drop-out regulators using a CMOS process, as described above. Accordingly, it would be desirable if a CMOS low drop-out regulator having a functionality equivalent to a bipolar low drop-out regulator were developed.

Figure 3:
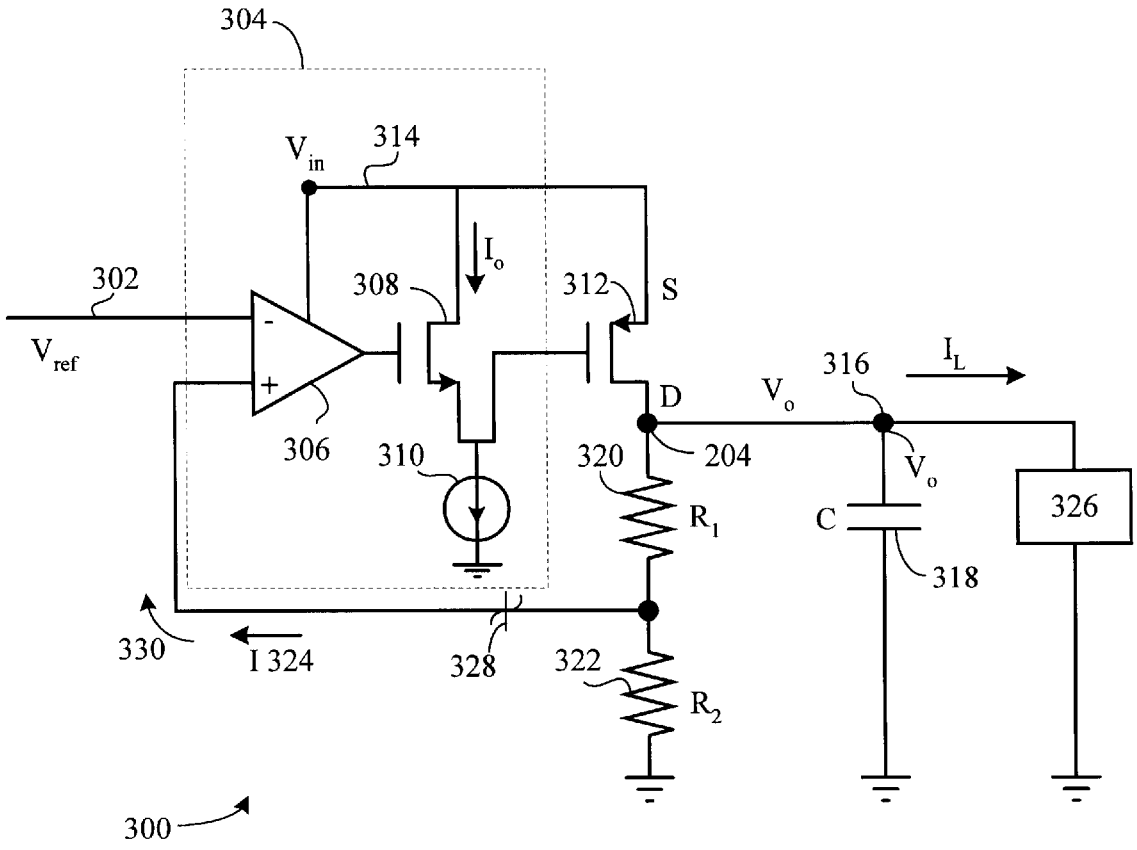
FIG. 3 is a circuit diagram illustrating a first low drop-out regulator fabricated using a CMOS process.

FIG. 3 is a circuit diagram illustrating a low drop-out regulator 300 fabricated using a CMOS process. As shown in FIG. 3, a reference voltage Vref 302 is coupled to a negative input of op amp 304. The op amp 304 may be equivalent to the op amp of FIG. 2, and may include operational amplifier (op amp) 306 and an output buffer including a transistor 308 and current source 310 (not shown in FIG. 2 to simplify illustration). The transistor 308 may include an N-channel MOS transistor or a bipolar NPN transistor implemented in a CMOS process. The low drop-out regulator 300 further includes a driver transistor 312 having a source coupled to an input voltage 314, a gate coupled to an output of the op amp 304, and a drain producing an output voltage 316. By way of example, the driver transistor 312 may include a P-channel MOS transistor. In addition, a capacitor 318 is provided to store energy and supply current to the circuit in instances when Vgs of the driver transistor 312 is low momentarily and the transistor 312 turns off. By way of example, the capacitance of the capacitor 318 may be approximately 1 uF. In addition, the low drop-out regulator 300 includes resistors $R_1$ 320 and $R_2$ 322. As described above, the current I 324 is preferably approximately zero. Accordingly, the output voltage Vo 316=($R_1$ 320+$R_2$ 322)/$R_2$ 322$*$Vref 302 is provided to load 326.

If noise 328 is present in loop 330, as it traverses the loop 330 in the clockwise direction, there will be some return noise 332. If this return noise 332 is additive to the noise 328, then the signal may oscillate limited by the input voltage supply 314. To sustain this oscillation, the return noise 332 should be in phase with the noise 328 as well as amplified by at least unity gain. To prevent the oscillation, the return noise 332 should either be in phase and have less than unity gain or be out of phase and have greater than unity gain.

Figure 4:
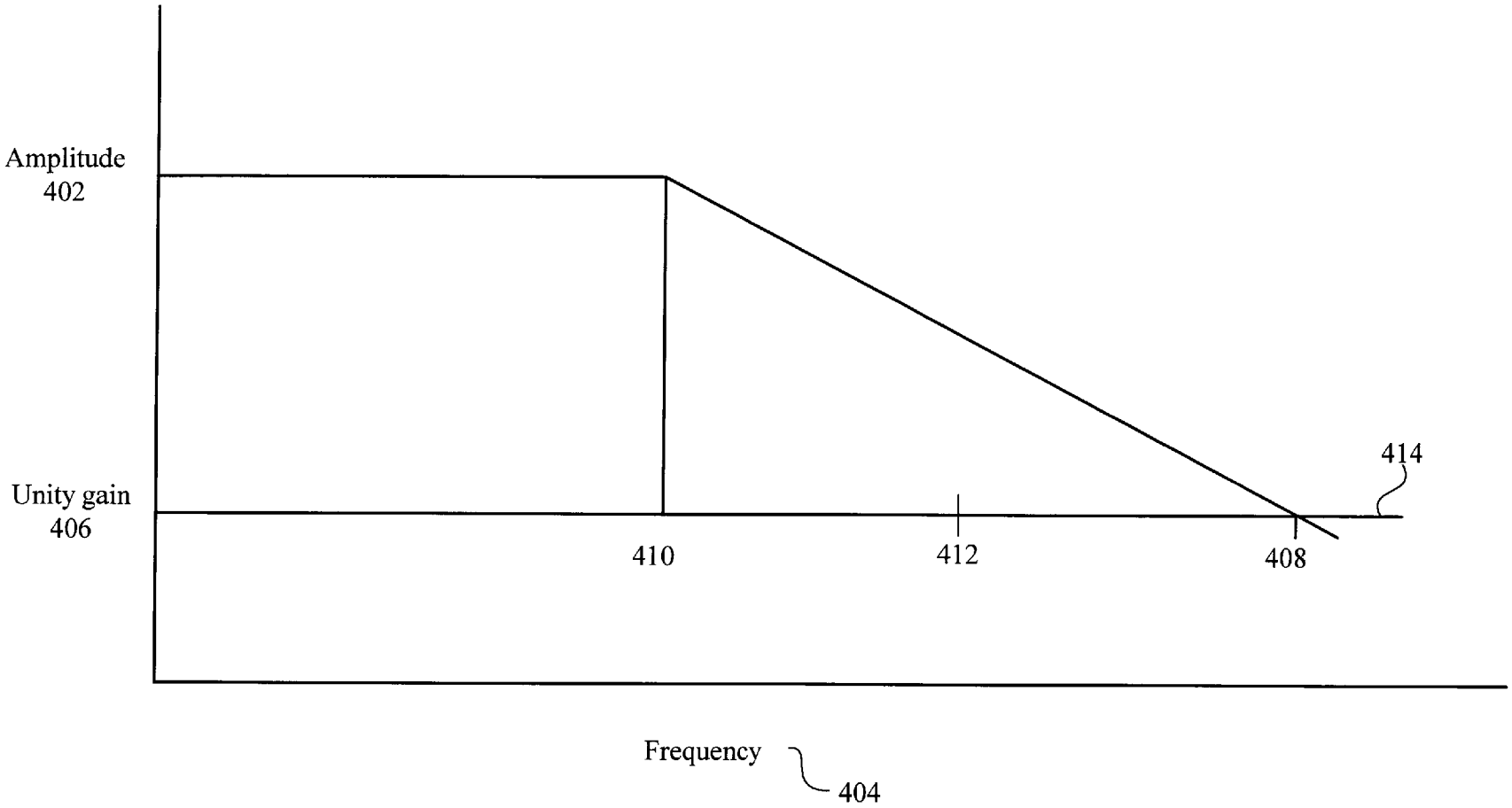
FIG. 4 is a graph illustrating a general amplitude vs frequency curve for a low dropout regulator.

In any given circuit loop (e.g., loop 330), it is well known that there can be only one dominant pole below the unity gain frequency in order to ensure an oscillation free regulator. However, there is typically more than one pole in a circuit loop such as loop 330. FIG. 4 is a graph illustrating a general amplitude 402 vs frequency 404 curve for a generalized low dropout regulator. The frequency at the "unity gain" 406 is the unity gain frequency 408. As shown, a dominant pole 410 exists below the unity gain frequency. However, if a second pole 412 were to exist below the unity gain frequency, the circuit would be unstable, creating oscillation in the output voltage. Accordingly, to guarantee the stability of the regulator, the second pole 414 must exist above the unity gain frequency 408.

Referring back to FIG. 3, within loop 330, there is both a dominant pole and a parasitic pole. The dominant pole fp is defined by the following equation: fp=1/(2πRout312$*$C318), where Rout312 is the output impedance of the driver transistor 312 and C318 is the capacitance of the capacitor 318. The output impedance Rout312=$V_A/I_L$, where $V_A$ is a process parameter, "early voltage". Thus, when the load current $I_L$ is approximately 0, the output impedance Rout312 is large. As a result, the dominant pole is low. However, when the load current $I_L$ increases, the output impedance Rout312 decreases. As a result, the dominant pole increases while the parasitic pole does not increase. Accordingly, both poles will be below the unity gain frequency, producing oscillation in the regulator.

One technique for ensuring an oscillation free circuit is to move the parasitic pole above the unity gain frequency. The parasitic pole is defined by the following equation: fpar=1/($2\pi R_{outbuff308}C_{par312}$), where $R_{outbuff308}$ is the output impedance of the output buffer, equivalent to the output impedance of the transistor 308, and $C_{par312}$ is the parasitic capacitance of the driver transistor transistor 312. In order to increase the frequency of the parasitic pole fpar, the output impedance of the output buffer $R_{outbuff308}$ may be reduced. The output impedance of the output buffer $R_{outbuff308}=V_a/I_d$ where $I_d$ is the current through the output buffer which includes current provided by the current source 310. Thus, to increase the output impedance of the output buffer 308, the current $I_d$ should be increased. In other words, the current source 310 must be sufficiently high to keep the output impedance of the output buffer 308 $R_{outbuff308}$ low in order to move the parasitic pole higher than the unity gain frequency. However, if no load current $I_L$ is taken, the regulator is taking unnecessarily high current to maintain an oscillation free regulator. The current efficiency may be defined by the following equation: $I_L/(I_L+I_{drain})$, where $I_{drain}$ is equivalent to all drain currents, including the current source 310. Thus, when the current Id through the output buffer is high, the current efficiency is high. But, when the load current $I_L$ is low, the current efficiency is low because $I_{drain}$ is constant. Accordingly, the CMOS low drop-out regulator of FIG. 3 results in power loss and increased operating costs.

Figure 5:
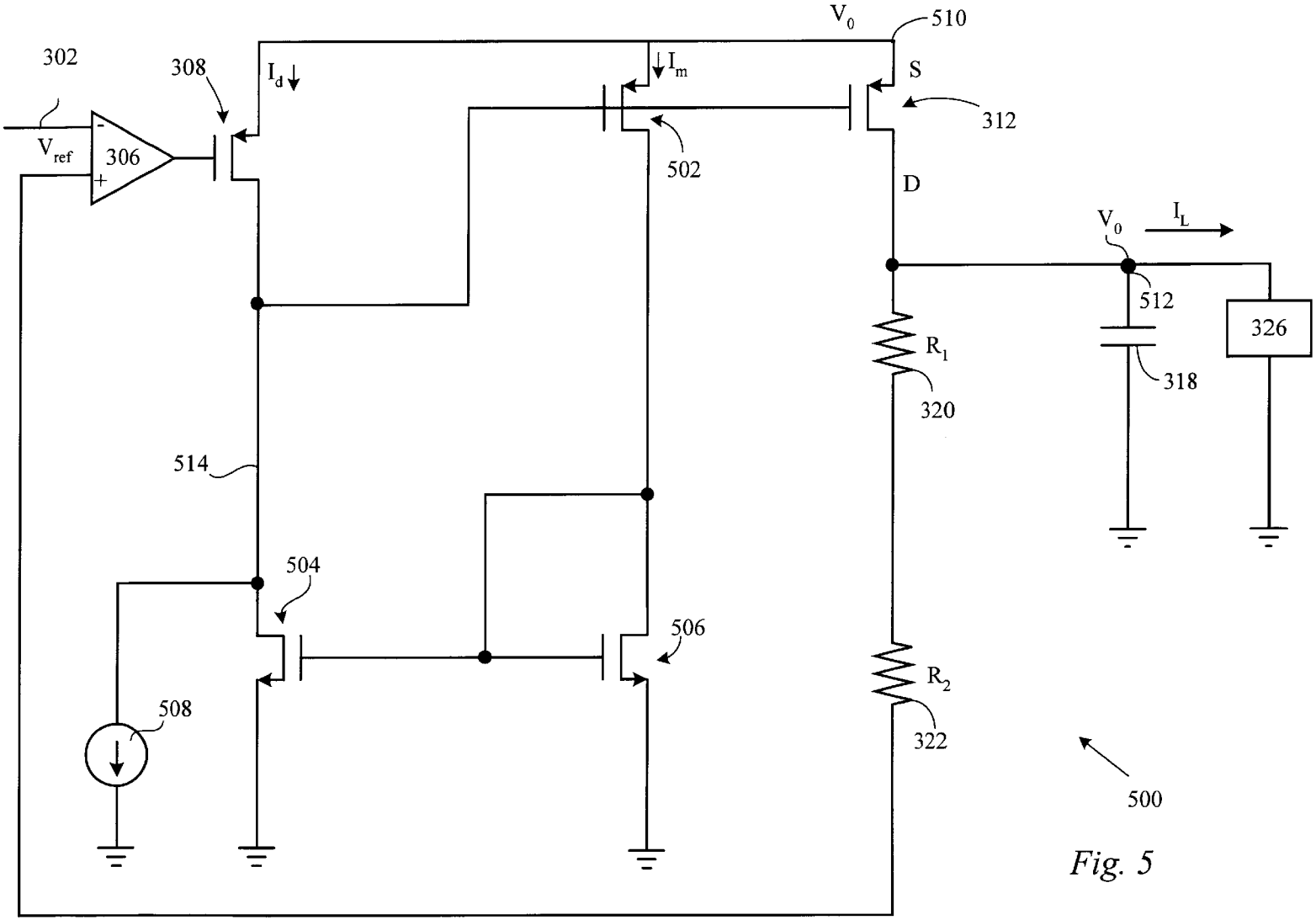
FIG. 5 is a circuit diagram illustrating a second low drop-out regulator fabricated using a CMOS process.

One approach to overcoming the disadvantages of the CMOS low drop-out regulator of FIG. 3 is illustrated generally in FIG. 5. The CMOS low drop-out regulator 500 of FIG. 5 attempts to mirror the load current such that the parasitic pole tracks the dominant pole. The low drop-out regulator 500 includes the reference voltage 302 coupled to the negative input of the op amp 306 which includes the output buffer transistor 308. In addition, the low drop-out regulator 500 includes the driver transistor 312, the capacitor 318, the resistors 320, 322, and the load 326, as shown in FIG. 3. In addition to the transistors illustrated in the low drop-out regulator of FIG. 3, the low drop-out regulator 500 further includes mirroring transistors 502, 504, 506. A minimum constant current source 508 (e.g., 20 uA) is provided for a minimum load current $I_L$ drawn by the load 326. As a result, when the load current $I_L$ is zero, the current source 508 provides a minimal current (e.g., through the transistor 308) to ensure that the parasitic pole remains outside the unity gain frequency. When the load current $I_L$ increases, the mirrored current through the mirroring transistors 502, 504, and 506 will also increase in proportion to the load current $I_L$. Thus, the current through the output buffer transistor 308 will be the sum of the current source 508 and the mirrored current. As a result, the output impedance $R_{outbuff308}$ decreases, increasing the parasitic frequency such that the parasitic pole remains above the unity gain frequency.

Figure 6:
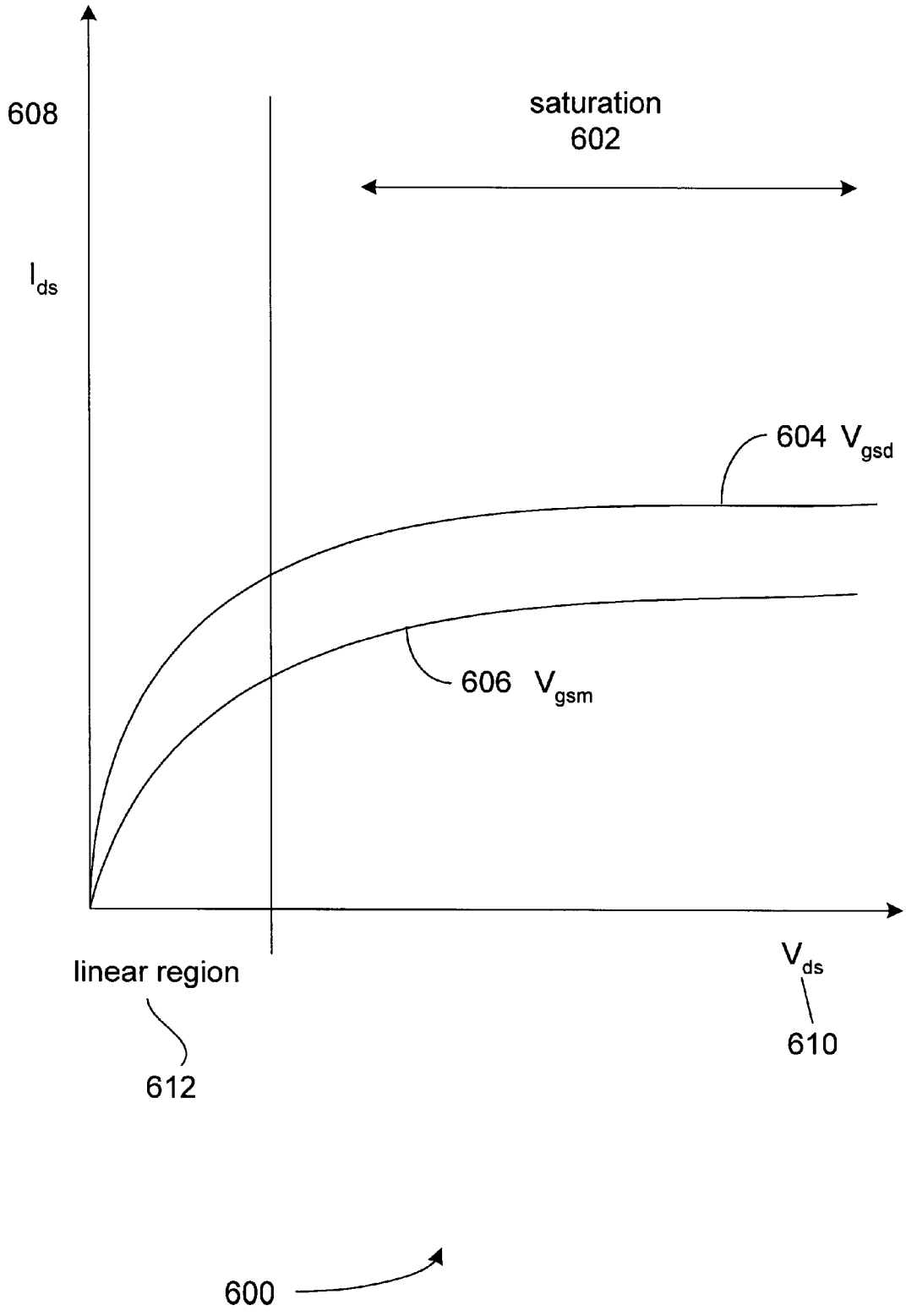
FIG. 6 is a general current $I_{DS}$ vs voltage $V_{DS}$ graph for driver and mirroring transistors.

Although the CMOS low drop-out regulator of FIG. 5 provides a mirroring of the load current, mirroring is not effective under all circumstances. More particularly, mirroring is accurate only when both transistors 312, 502 are in saturation. As shown in FIG. 6, a general current $I_{DS}$ vs voltage $V_{DS}$ graph 600 for the driver and mirroring transistors is presented. In saturation mode 602, there is little change in $I_{DS}$ 608 for the driver transistor 604 and the mirroring transistor 606 as $V_{DS}$ 610 increases. Thus, if both transistors are in saturation and the gate voltage $V_G$ and the source voltage $V_S$ are identical for the driver and the mirroring transistor, then the current will be the same if the size of the transistors is identical. As a result, mirroring will be accurate when both the driver and mirroring transistors are in saturation. However, in the linear region 612, the current Ids 608 changes appreciably with $V_{DS}$ 610. Accordingly, both the driver and the mirroring transistors will have different currents Ids 608 and mirroring will be inaccurate in the linear region 612.

Referring back to FIG. 5, it is necessary to determine the circumstances in which the driver transistor will operate in the linear region. As described above, in low drop-out mode, the voltage difference between the input voltage and the output voltage is minimized. By way of example, the drop-out voltage may be between approximately 100 and approximately 200 millivolts. As shown in FIG. 5, the input voltage 510 is the voltage at the source of the driver transistor 312 and the output voltage 512 is the voltage at the drain of the driver transistor 312. Thus, the drop-out voltage is identical to $V_{DS}$ of the driver transistor 312, and $V_{DS}$ in low drop-out mode is between approximately 100 and approximately 200 millivolts. For a MOS transistor to operate in saturation, $|V_{DS}|>=|V_{GS}-V_{TH}|$, where $V_{TH}$ is the threshold voltage. In addition, the physical size of a transistor W/L is directly related the gate-to-source voltage $V_{GS}$. Thus, the larger the $V_{GS}$, the smaller the transistor size W/L that can be used to produce the same resistance. By way of example, if the $V_{GS}$ is high, a low W/L is required for a fixed current $I_D$. It is therefore desirable to maintain the voltage at the gate VG as low as possible (e.g., 1 volt), thereby maintaining $V_{GS}$ as high as possible such that a reasonable size transistor device may be utilized for the driver transistor 312 W/L. By way of example, if the voltage at the gate of the driver transistor 312, shown at node 514, is 1 volt and the input voltage at the source of the driver transistor 312, shown at node 510, is 5 volts, then $V_{GS}$ for the driver transistor is 4 volts. Assuming $V_{TH}$=1 volt, $V_{DS}$ (e.g., 0.2) is not larger than $V_{GS}-V_{TH}$ (e.g., 4–1). As a result, the driver transistor will operate in the linear region rather than the saturation region and mirroring will be inaccurate. Accordingly, the CMOS low drop-out regulator of FIG. 5 does not function in low drop-out mode under all circumstances.

In view of the difficulty encountered in designing low drop-out regulators in the CMOS process, it would be desirable if low drop-out regulators were designed such that accurate mirroring is provided in both the linear and saturation regions. As described above and illustrated generally in FIG. 5 and FIG. 6, in saturation, mirroring is accurate if $V_{GS}$ for both the mirroring and the driver transistors is identical. However, it has not been possible to design a CMOS low drop-out regulator that is also operable in the linear region.

In order to ensure that mirroring is exact in the linear region, one embodiment of the invention ensures that both $V_{GS}$ and $V_{DS}$ are identical for both the mirroring transistor and the driver transistor. As will be described below, the $V_{DS}$ of the mirroring transistor is forced to that of the driver transistor. This is accomplished through providing accurate mirroring of the load current in both the linear and the saturation regions.

Figure 7:
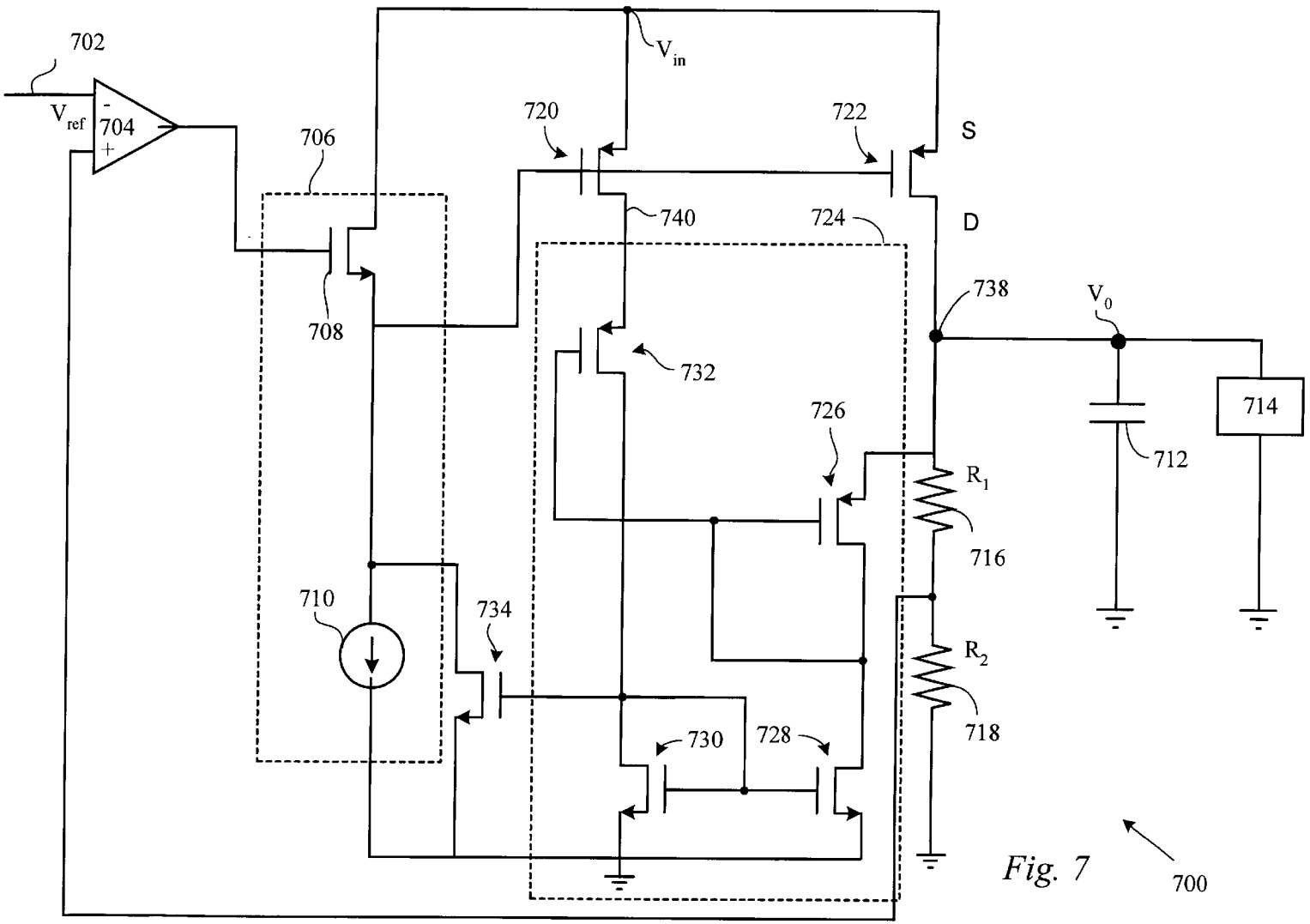
FIG. 7 is a circuit diagram illustrating a low drop-out regulator fabricated using a CMOS process according to one embodiment of the invention.

Referring to FIG. 7, a circuit diagram illustrating a low drop-out regulator 700 fabricated using a CMOS process according to one embodiment of the invention is presented. As shown in FIG. 7, a reference voltage Vref 702 is coupled to inverting input of op amp 704. In addition, an output buffer 706 coupled to the op amp 704 includes transistor 708 and current source 710. A capacitor 712 and load 714 are provided, as well as resistors 716, 718. Mirroring transistor 720 is coupled to driver transistor 722. In addition, a means for mirroring a portion of the current through the driver transistor 722, or the load current, in the mirroring transistor 720 is provided. By way of example, the means for mirroring the current through the driver transistor 722 may include a mirroring circuit 724. The mirroring circuit 724 may be coupled to the driver transistor such that a voltage differential between the drain and the source of the driver transistor 722, $V_{DS}$, is mirrored in the mirroring transistor 720. This may be accomplished by coupling the sources of both the driver transistor 722 and the mirroring transistor 720 to an input supply voltage while forcing the drains of both transistors 720, 722 to an identical voltage.

As shown in FIG. 7, the mirroring circuit 724 includes an input coupled to the drain of the driver transistor 722 and an output coupled to the drain of the mirroring transistor 720, and is adapted for sensing the voltage at the input and placing the sensed voltage at the output of the mirroring circuit 724. According to one embodiment of the present invention, the mirroring circuit 724 may include a first transistor 726, a second transistor 728, a third transistor 730, a fourth transistor 732, and a fifth transistor 734. The first transistor 726 and the fourth transistor 732 preferably have the same dimensions. Similarly, the second transistor 728, the third transistor 730, and the fifth transistor 734 are preferably identical in size. In addition, the mirroring transistor 720 must be a fraction (e.g., 1/1000) of the size of the driver transistor 722 in order to mirror only a fraction of the load current. The driver transistor 722 includes a source connected to input supply voltage 736, a drain producing an output voltage 738, and a gate. In addition, the mirroring transistor 720 includes a source coupled to the input supply voltage 736, a drain, and a gate coupled to the gate of the driver transistor 722. Each transistor may be implemented in a CMOS process. By way of example, each transistor may be implemented as an N-channel MOS transistor or a P-channel MOS transistor. By way of example, the second, third, and fifth transistors may be N-channel MOS transistors, and the first and fourth transistors may be P-channel MOS transistors.

Each of the transistors in the mirroring circuit 724 is coupled such that the voltage differential between the drain and the source of the driver transistor 722, $V_{DS}$, is mirrored in the mirroring transistor 720. As shown, the first transistor 726 includes a source coupled to the drain of the driver transistor 722, a drain, and a gate coupled to the drain of the first transistor 726. In addition, the second transistor 728 includes a drain coupled to the drain of the first transistor 726, a source coupled to a reference voltage potential (e.g., ground), and a gate. The third transistor 730 includes a gate coupled to the gate of the second transistor 728, a source coupled to ground, and a drain coupled to the gate of the third transistor 730. Similarly, the fourth transistor 732 includes a drain coupled to the drain of the third transistor 730, a source coupled to the drain of the mirroring transistor 720, and a gate coupled to the gate of the first transistor 726. The fifth transistor 734 includes a source connected to ground, a gate connected to the gate of the third transistor 730, and a drain. Although the mirroring circuit 724 is described as including transistors 726, 728, 730, 732, 734, the mirroring circuit 724 may be implemented in alternate equivalent circuitry.

As described above, the voltage differential between the gate and the source, $V_{GS}$, is identical for the mirroring transistor 720 and the driver transistor 722. By way of example, the gate of the driver transistor 722 may be coupled to the gate of the mirroring transistor 720, and the source of the driver transistor 722 and the source of the mirroring transistor 720 may be coupled to the input supply voltage 736. Accordingly, since $V_{GS}$ and $V_{DS}$ are identical for both the mirroring transistor 720 and the driver transistor 722, mirroring will be accurate and the low drop-out regulator will be functional in both the linear and saturation regions.

During the operation of the mirroring circuit 724, the mirroring circuit 724 senses the voltage at the drain of the driver transistor 722 and forces the voltage at the drain of the mirroring transistor 720 to the sensed voltage. This is accomplished through mirroring a portion of the current that is flowing through the driver transistor 722, or the load current $I_L$ in the mirroring transistor 720. Proper mirroring of the load current is performed in part through the use of appropriate transistor sizes. Since the second transistor 728, the third transistor 730, and the fifth transistor 734 are the same size and the gates are connected, the current through the transistors 728, 730, 734 is identical. In addition, the same current flows through the first transistor 726 and the fourth transistor 732 since they are the same size and the gates are connected. Since the current through the first transistor 726 and the fourth transistor 732 is identical, the voltages at the drains of the driver transistor 722 and the mirroring transistor 720 are identical. In other words, the transistor 726 senses the output voltage 738 at the drain of the driver transistor 722 and forces the voltage at the drain of the mirroring transistor 720 (as shown at node 740) to the sensed voltage. Therefore, the $V_{DS}$ is identical for both the driver transistor 722 and the mirroring transistor 720. As a result, the mirroring circuit 724 in combination with the mirroring transistor 720 will produce a mirrored current proportional to the size of the transistors. The current through the output buffer 706 will be a sum of the current source 710 and the mirrored current, thereby ensuring that the parasitic pole frequency is greater than the unity gain frequency. Accordingly, the low drop-out regulator of the present invention ensures an oscillation free circuit even when the driver transistor 722 and the mirroring transistor 720 are operating in the linear region.

The present invention provides, in one implementation, a drop-out voltage of between approximately 100 millivolts and approximately 200 millivolts with low bias current. This is accomplished by mirroring a portion of the load current in both linear and saturation regions. As a result, the present invention provides accurate mirroring while providing a high current efficiency. In addition, the driver transistor may be implemented using a smaller transistor than previously possible. Moreover, since the CMOS process is utilized, a single process may be used during fabrication. In addition, regulator designers may take advantage of existing research relating to CMOS processes. Accordingly, the present invention provides reduced power consumption and operating costs, as well as reduced manufacturing costs.

Although illustrative embodiments and applications of this invention are shown and described herein, many variations and modifications are possible which remain within the concept, scope, and spirit of the invention, and these variations would become clear to those of ordinary skill in the art after perusal of this application. For instance, the present invention is described as utilizing a mirroring circuit. Although the mirroring circuit is shown and described as comprising five CMOS transistors, it should be understood that the present invention is not limited to such an exemplary arrangement, but instead would equally apply if a different arrangement of CMOS transistors were utilized. Accordingly, the present embodiments are to be considered as illustrative and not restrictive, and the invention is not to be limited to the details given herein, but may be modified within the scope and equivalents of the appended claims.

What is claimed is:

1. A low drop-out regulator, comprising:

a driver transistor adapted for connecting to an input supply voltage and producing an output voltage;

a mirroring transistor coupled to the driver transistor, the driver transistor and the mirroring transistor being implemented in a CMOS process and each having a gate, a source, and a drain, wherein a voltage differential between the drain and the source of the driver transistor is mirrored in the mirroring transistor, wherein the drain of the driver transistor is coupled to the output voltage, and wherein the driver transistor and the mirroring transistor are each implemented as a P-channel MOS transistor; and a mirroring circuit adapted for sensing a voltage at the drain of the driver transistor and forcing a voltage at the drain of the mirroring transistor equal to the sensed voltage that includes, a first CMOS transistor having a source coupled to the drain of the driver transistor, a drain, and a gate coupled to the drain of the first transistor, a second CMOS transistor having a drain coupled to the drain of the first transistor, a source coupled to ground, and a gate, a third CMOS transistor having a gate coupled to the gate of the second transistor, a source coupled to the ground, and a drain coupled to the gate of the third transistor, a fourth CMOS transistor having a drain coupled to the drain of the third transistor, a source coupled to the drain of the mirroring transistor, and a gate coupled to the gate of the first transistor, and a fifth CMOS transistor having a source connected to the ground, a gate connected to the gate of the third transistor, and a drain, wherein the second, third, and fifth transistors are N-channel MOS transistors and the first and fourth transistors are P-channel MOS transistors.

2. The low drop-out regulator as recited in claim 1, wherein the mirroring circuit further includes:

an output buffer coupled to the drain of the fifth transistor and the gates of the driver and the mirroring transistors.

3. A low drop-out regulator, comprising:

a driver transistor adapted for connecting to an input supply voltage and producing an output voltage;

a mirroring transistor coupled to the driver transistor, the driver transistor and the mirroring transistor being implemented in a CMOS process and each having a gate, a source, and a drain, wherein a voltage differential between the drain and the source of the driver transistor is mirrored in the mirroring transistor, wherein the drain of the driver transistor is coupled to the output voltage, wherein the driver transistor and the mirroring transistor are each implemented as a PMOS transistor, wherein a voltage differential between the gate and the source is identical for the mirroring transistor and the driver transistor, and wherein the gate of the driver transistor is coupled to the gate of the mirroring transistor, and the source of the driver transistor and the source of the mirroring transistor are coupled to the input supply voltage; and a mirroring circuit adapted for sensing a voltage at the drain of the driver transistor and forcing a voltage at the drain of the mirroring transistor equal to the sensed voltage, wherein the mirroring circuit includes, a first CMOS transistor having a source coupled to the drain of the driver transistor, a drain, and a gate coupled to the drain of the first transistor, a second CMOS transistor having a drain coupled to the drain of the first transistor, a source coupled to ground, and a gate, a third CMOS transistor having a gate coupled to the gate of the second transistor, a source coupled to the ground, and a drain coupled to the gate of the third transistor, a fourth CMOS transistor having a drain coupled to the drain of the third transistor, a source coupled to the drain of the mirroring transistor, and a gate coupled to the gate of the first transistor, and a fifth CMOS transistor having a source connected to the ground, a gate connected to the gate of the third transistor, and a drain, wherein the first transistor and the fourth transistor are identical in size and the second transistor, the third transistor, and the fifth transistor are identical in size, wherein the second, third, and fifth transistors are N-channel MOS transistors and the first and fourth transistors are P-channel MOS transistors, and wherein the mirroring transistor and the mirroring circuit produce a mirrored current proportional in size to the first, second, third, fourth, and fifth transistors.

4. A method for providing a low drop-out regulator, comprising:

providing a driver transistor adapted for connecting to an input supply voltage and producing an output voltage;

providing a mirroring transistor coupled to the driver transistor, the driver transistor and the mirroring transistor being implemented in a CMOS process and each having a gate, a source, and a drain;

ensuring that a voltage differential between the drain and the source of the driver transistor is mirrored in the mirroring transistor, wherein the driver transistor and the mirroring transistor are each implemented as a P-channel MOS transistor;

sensing the output voltage at the driver transistor;

mirroring the voltage differential between the drain and the source of the driver transistor in the mirroring transistor;

coupling the drain of the driver transistor to the output voltage;

sensing a voltage at the drain of the driver transistor;

forcing a voltage at the drain of the mirroring transistor equal to the sensed voltage;

coupling the source of the driver transistor and the source of the mirroring transistor to the input supply voltage;

coupling the drain of the driver transistor to the output voltage;

providing a mirroring circuit having an input coupled to the drain of the driver transistor and an output coupled to the drain of the mirroring transistor, the mirroring circuit adapted for sensing the output voltage at the input of the mirroring circuit and placing the sensed output voltage at the output of the mirroring circuit, wherein providing the mirroring circuit includes, providing a first CMOS transistor having a source coupled to the drain of the driver transistor, a drain, and a gate coupled to the drain of the first transistor;

providing a second CMOS transistor having a drain coupled to the drain of the first transistor, a source coupled to ground, and a gate;

providing a third CMOS transistor having a gate coupled to the gate of the second transistor, a source coupled to the ground, and a drain coupled to the gate of the third transistor;

providing a fourth CMOS transistor having a drain coupled to the drain of the third transistor, a source coupled to the drain of the mirroring transistor, and a gate coupled to the gate of the first transistor;

providing a fifth CMOS transistor having a source connected to the ground, a gate connected to the gate of the third transistor, and a drain; and wherein the second, third, and fifth transistors are N-channel MOS transistors and the first and fourth transistors are P-channel MOS transistors, and providing an output buffer coupled to the drain of the fifth transistor and the gates of the driver and the mirroring transistors.

5. A method for providing a low drop-out regulator, comprising:

providing a driver transistor adapted for connecting to an input supply voltage and producing an output voltage;

providing a mirroring transistor coupled to the driver transistor, the driver transistor and the mirroring transistor being implemented in a CMOS process and each having a gate, a source, and a drain, wherein the driver transistor and the mirroring transistor are each implemented as a PMOS transistor;

ensuring that a voltage differential between the drain and the source of the driver transistor is mirrored in the mirroring transistor;

coupling the source of the driver transistor and the source of the mirroring transistor to the input supply voltage;

coupling the drain of the driver transistor to the output voltage; and providing a mirroring circuit having an input coupled to the drain of the driver transistor and an output coupled to the drain of the mirroring transistor, the mirroring circuit adapted for sensing the output voltage at the input of the mirroring circuit and placing the sensed output voltage at the output of the mirroring circuit, wherein providing the mirroring circuit includes:

providing a first CMOS transistor having a source coupled to the drain of the driver transistor, a drain, and a gate coupled to the drain of the first transistor;

providing a second CMOS transistor having a drain coupled to the drain of the first transistor, a source coupled to ground, and a gate;

providing a third CMOS transistor having a gate coupled to the gate of the second transistor, a source coupled to the ground, and a drain coupled to the gate of the third transistor;

providing a fourth CMOS transistor having a drain coupled to the drain of the third transistor, a source coupled to the drain of the mirroring transistor, and a gate coupled to the gate of the first transistor; and providing a fifth CMOS transistor having a source connected to the ground, a gate connected to the gate of the third transistor, and a drain;

wherein the first transistor and the fourth transistor are identical in size and the second transistor, the third transistor, and the fifth transistor are identical in size;

wherein the second, third, and fifth transistors are N-channel MOS transistors and the first and fourth transistors are P-channel MOS transistors.

6. The method as recited in claim 5, wherein the mirroring transistor and the mirroring circuit produce a mirrored current proportional in size to the first, second, third, fourth, and fifth transistors.

7. The method as recited in claim 5, further including:

ensuring that a voltage differential between the gate and the source is identical for the mirroring transistor and the driver transistor.

8. The method as recited in claim 7, further including:

coupling the gate of the driver transistor to the gate of the mirroring transistor; and coupling the source of the driver transistor and the source of the mirroring transistor to the input supply voltage.

9. A low drop-out regulator, comprising:

a driver transistor adapted for connecting to an input supply voltage and producing an output voltage; and a mirroring transistor coupled to the driver transistor, the driver transistor and the mirroring transistor being implemented in a CMOS process and each having a gate, a source, and a drain, wherein a voltage differential between the drain and the source of the driver transistor is mirrored in the mirroring transistor, wherein the driver transistor and the mirroring transistor are each implemented as a P-channel MOS transistor, and wherein the source of the driver transistor and the source of the mirroring transistor are coupled to the input supply voltage and the drain of the driver transistor is coupled to the output voltage; and a mirroring circuit having an input coupled to the drain of the driver transistor and an output coupled to the drain of the mirroring transistor, the mirroring circuit adapted for sensing the output voltage at the input of the mirroring circuit and placing the sensed output voltage at the output of the mirroring circuit that includes, a first CMOS transistor having a source coupled to the drain of the driver transistor, a drain, and a gate coupled to the drain of the first transistor;

a second CMOS transistor having a drain coupled to the drain of the first transistor, a source coupled to ground, and a gate;

a third CMOS transistor having a gate coupled to the gate of the second transistor, a source coupled to the ground, and a drain coupled to the gate of the third transistor;

a fourth CMOS transistor having a drain coupled to the drain of the third transistor, a source coupled to the drain of the mirroring transistor, and a gate coupled to the gate of the first transistor;

a fifth CMOS transistor having a source connected to the ground, a gate connected to the gate of the third transistor, and a drain;

wherein the second, third, and fifth transistors are N-channel MOS transistors and the first and fourth transistors are P-channel MOS transistors.

10. The low drop-out regulator as recited in claim 9 wherein the mirroring circuit further includes:

an output buffer coupled to the drain of the fifth transistor and the gates of the driver and the mirroring transistors.

11. A low drop-out regulator, comprising:

a driver transistor adapted for connecting to an input supply voltage and producing an output voltage;

a mirroring transistor coupled to the driver transistor, the driver transistor and the mirroring transistor being implemented in a CMOS process and each having a gate, a source, and a drain, wherein a voltage differential between the drain and the source of the driver transistor is mirrored in the mirroring transistor, wherein the driver transistor and the mirroring transistor are each implemented as a P-channel MOS transistor, and wherein the source of the driver transistor and the source of the mirroring transistor are coupled to the input supply voltage and the drain of the driver transistor is coupled to the output voltage; and a mirroring circuit having an input coupled to the drain of the driver transistor and an output coupled to the drain of the mirroring transistor, the mirroring circuit adapted for sensing the output voltage at the input of the mirroring circuit and placing the sensed output voltage at the output of the mirroring circuit that includes, a first CMOS transistor having a source coupled to the drain of the driver transistor, a drain, and a gate coupled to the drain of the first transistor;

a second CMOS transistor having a drain coupled to the drain of the first transistor, a source coupled to ground, and a gate;

a third CMOS transistor having a gate coupled to the gate of the second transistor, a source coupled to the ground, and a drain coupled to the gate of the third transistor;

a fourth CMOS transistor having a drain coupled to the drain of the third transistor, a source coupled to the drain of the mirroring transistor, and a gate coupled to the gate of the first transistor;

a fifth CMOS transistor having a source connected to the ground, a gate connected to the gate of the third transistor, and a drain;

wherein the second, third, and fifth transistors are N-channel MOS transistors and the first and fourth transistors are P-channel MOS transistors.

12. The low drop-out regulator as recited in claim 11 wherein the mirroring circuit further includes:

an output buffer coupled to the drain of the fifth transistor and the gates of the driver and the mirroring transistors.

* * * * *